US006216445B1

(12) United States Patent
Byers et al.

(10) Patent No.: US 6,216,445 B1
(45) Date of Patent: Apr. 17, 2001

(54) MICRO PULSED PLASMA THRUSTER AND METHOD OF OPERATING SAME

(75) Inventors: David C. Byers, Torrance; David H. Lewis, Jr., Irvine, both of CA (US)

(73) Assignees: TRW Inc., Redondo Beach; California Institute of Technology, Pasadena, both of CA (US)

( * ) Notice: Subject to any disclaimer, the term of this patent is extended or adjusted under 35 U.S.C. 154(b) by 0 days.

(21) Appl. No.: 09/315,211

(22) Filed: May 19, 1999

(51) Int. Cl.[7] ..... G21D 1/00; H05B 1/00
(52) U.S. Cl. ..... 60/203.1; 60/202
(58) Field of Search ..... 60/203.1, 202, 60/204, 200.1; 315/111.01, 111.2

(56) References Cited

U.S. PATENT DOCUMENTS 3,447,322 * 6/1969 Mastrup ..... 60/203
4,301,391 * 11/1981 Seliger et al. ..... 315/111.31
4,821,508 * 4/1989 Burton et al. ..... 60/203.1
4,821,509 * 4/1989 Burton et al. ..... 60/203.1
4,995,231 * 2/1991 Smith et al. ..... 60/203.1
5,239,820 * 8/1993 Leifer et al. ..... 60/202
5,439,191 8/1995 Nichols ..... 244/169

* cited by examiner

*Primary Examiner*—Timothy S. Thorpe
*Assistant Examiner*—William Rodriguez
(74) *Attorney, Agent, or Firm*—Michael S. Yatsko

(57) ABSTRACT

A pulse plasma thruster (50) utilizes a vapor producing solid (54) and a micro-sized heater (52) to produce a high pressure vapor that is directed into an ignition chamber (58) and to a thrust discharge chamber (70). The thrust discharge chamber (70) comprises two oppositely disposed electrode plates (72, 74) and oppositely disposed fuel propellants sources (60, 62). The passageway (56) leading from vapor producing solid (54) to the thrust discharge chamber (70) is configured to permit uniform feeding of the vapors to the thrust discharge chamber (70). A pair of electrode terminals (82, 84) extend from the electrode plates (72, 74) and through a housing (88). A power source (100) is coupled to the terminals (82, 84) and provides the ignition signals necessary to cause a spark and a breakdown to a useful plasma arc by controlling the voltage-current shape of the ignition signal.

41 Claims, 4 Drawing Sheets

MICRO PULSED PLASMA THRUSTER AND METHOD OF OPERATING SAME

TECHNICAL FIELD

The invention relates generally to plasma thrusters and more particularly to a miniature pulsed plasma thruster capable of efficiently generating very small impulse bits at low levels of power and DC ignition voltages.

BACKGROUND OF THE INVENTION

Space vessels such as spaceships and satellites utilize thrusters to achieve motion in space. A thruster operates on the principle that a force generated in one direction generates an equal force in the opposite direction. By emitting a reaction-mass, a thruster accelerates a spacecraft in the opposite direction. A thruster may be used as a small rocket engine for orbit correction or as the main propulsion of the spacecraft.

Older conventional thrusters used chemical propulsion, which utilized liquid and/or solid propellants. Electric thrusters, which accelerate gases by electrical heating and/or by electric and magnetic field forces, can outperform chemical propulsion systems, in part, because of their high specific impulse (Isp) values. Advantages of electric thrusters include high efficiency and performance, low weight, increased spacecraft orbiting lifetimes, reduced overall costs, and a savings in fuel mass. Advances in onboard electric power sources and smaller more efficient electronic devices have expanded the use of electric thrusters in spacecraft applications.

Electric thrusters that convert electrical energy into kinetic energy may be grouped into three categories: electro thermal propulsion, electrostatic or ion propulsion, and electromagnetic propulsion. Within the electromagnetic propulsion category is the Pulsed Plasma Thruster (PPT), which accelerates the propellant plasma via interaction with an electric arc.

Multiple government and civil entities are developing small and micro sized spacecraft that can benefit from PPTs for space missions. Such spacecraft will require major reductions in thrust levels and/or impulse bits to ensure proper and precise control of the spacecraft. Many missions, in particular those that require significant mission propulsion energies and/or acceleration, will require specific impulses beyond those available from chemical rockets. Because present electric rockets cannot efficiently operate a very low level of power and impulse bits they are not well suited for such missions.

While PPTs are at a high state of development, they generally require high levels of voltage and power to initiate the plasma breakdown and are also very inefficient at low powers when operated at values of expelled propellant velocities of interest to space missions. For example, experimental PPTs have been operated at energy levels down to about 2 joules (J) per pulse requiring the use of high voltage charging supplies which can range from 2,000 to 8,000 volts depending on the design. Also, efficiencies of PPTs decrease with decreasing power and presently, are less than 10 percent efficient when operated at values of propellant velocities of interest to space systems. The inefficiencies result in significant increases in power to achieve desired levels of impulse bits.

An example of such a thruster is shown in FIG. 1 and denoted generally as 10. The thruster 10 fits into the class of propellant devices that operates using an all gas propellent although an all solid solution could also be utilized. In particular, the thruster 10 utilizes a low atomic weight liquid propellant such as water or monopropellant hydrazine ($N_2H_4$) or a mixture of two liquids such as water and hydrazine which is stored in the tank 12 and flows through a conduit 14 leading to an opening 16 that forms the feeding mechanism of the thruster 10. The liquid propellent within the tank 12 may be pressurized by high pressure helium in the tank 20, in a manner well known to those of ordinary skill in the art.

The liquid propellent flows through the conduit 14 via the opening 16 and reaches a passage 18 within the thruster 10. The passage 18 leads to a small opening 22 which is sized to provide the correct flow velocity for the liquid propellent and reduce back flow into the passage 18. In the passage 18, the liquid propellent is partially or fully atomized and partially evaporated, so that there is a two phase flow of liquid and gas into the thruster 10. The liquid propellent is disassociated into low atomic weight elemental constituents thereof by an electric discharge that forms a plasma arc within the thruster 10.

The liquid gas and plasma flow from an open end 24 of the passage 18 into the thrust nozzle 30 which, as shown, is shaped as a cone or bell having a curved confining surface, to provide high efficiency and conversion of the high pressure plasma into a directed supersonic flow having high momentum. This discharge of plasma is established primarily by the use of a high voltage DC (HVDC) power supply 32 which is coupled to electrodes 34 and 36 of the thruster 10.

In particular, the thruster 10 operates when liquid from the tank 12 flows into the passage 18 and a high voltage ignition signal supplied by the HVDC power supply 32 is applied at terminals 34 and 36 at a predetermined frequency, such as 200 pulses per second, for example. This ignition voltage can vary but according to one design ranges from 2,000 volts to 8,000 volts. The ignition signal supplied by the HVDC power supply 32 causes a discharge to be established in the passage 18 between the electrodes 34 and 36 at a time when partially atomized fluid is entering the thrust nozzle 30 through the opening 24. The velocity and mass flow rate of liquid flowing through the passage 18 and the repetition rate and energy of the plasma discharge between the electrodes 34 and 36 are matched to achieve optimum operation.

Typically, the HVDC power supply 32 raises the voltage of the thruster 10 until an electrical breakdown occurs between the electrodes 34 and 36. The requirement, however, that the HVDC supply 32 generate high levels of ignition voltages makes the thruster 10 unsuitable for many propulsion applications where small spacecraft are involved. The HVDC supply 32 can be large and not well suited for such applications. Moreover due to its size, the HVDC supply 32 makes it difficult to achieve small and precise maneuvers for some spacecraft missions.

For many space mission applications, where small space systems are involved and which require extremely precise control, the use of high power and/or high voltage ignition circuits is impractical. Examples of such missions are those which require extremely precise ephemeris control and those which are otherwise penalized by high thrust, such as missions which require multiple acceleration and deceleration maneuvers. Thus a PPT that is able to efficiently operate without a high voltage ignitor system and at power levels several orders of magnitude less than prior art designs would be advantageous.

SUMMARY OF THE INVENTION

The present invention is a pulsed plasma thruster (PPT) capable of operating at low levels of power and impulse bits that is suitable for use in space applications where the space system is small and precise control of the spacecraft is required. The PPT of the present invention is capable of delivering reliable ignition of a spark breakdown at DC voltages less than 300 volts with reliable transfer of a spark to a useful plasma arc. The ablation, combustion and acceleration of the Polytetra Fluorethylene (PTFE) fuel propellent is precisely controlled with the use of miniaturized PPT and power processor components. The efficiency of the thruster is increased by the independent introduction of vapor (such a from a subliming solid) at optimal locations and times during the operational cycle.

According to one embodiment, disclosed is a PPT having optimally located solids capable of producing high vapor pressures for purposes of enhancing both ignition and efficiency. Heat generating elements, such as micro-heaters, are placed adjacent to the solids and configured to generate heat that causes the solids to sublime. The PPT includes an igniter section that forms a passageway from the solid to a thrust discharge chamber. In one embodiment, the ignition chamber includes a plurality of holes which are sized and spaced for optimally guiding vapors to the thrust discharge chamber for purposes of enabling arc ignitions at low voltages. In one embodiment, solids are also located within the thrust discharge chamber and, via the use of heat generating elements, independently introduce vapors into the thrust discharge chamber in order to enhance PPT efficiency at desired values of propellant velocities.

The thrust discharge chamber includes a set of properly spaced and shaped electrode plates which provide for transfer of an initial spark to a useful plasma arc in the gap defined by the electrodes plates. A solid propellent, such as PTFE, is provided within the thrust discharge chamber and arranged so that the plasma arc traveling through the thrust discharge chamber will ablate the PTFE and accelerate the plasma formed from ablated PTFE and the independently introduced vapor from high vapor pressure solids, as used.

A power processing unit provides the DC ignition voltage necessary to cause a spark to occur in the gap between the electrode plates. In one embodiment, the power processor unit has a variable output that operates in three segments: an open circuit to constant voltage segment, a constant voltage segment, and a constant current segment.

A high vapor pressure between the electrode plates is created when the heat generating means heats the solid to assist in ignition and transition of a spark to a useful plasma arc. Micro-heaters can also be embedded in, or at the edges of, the PTFE propellent and its temperature varied to control the amount of PTFE ablated to provide more control of the impulse generated by the PPT. Micro-heaters embedded in the solids, located in the ignitions section and/or the thrust discharge chamber, independently provide a source of vapor to the thrust discharge chamber to provide additional and independent control of the efficiency and impulse of the PPT. In one embodiment the electrode plates are equally spaced about a central axis through the thrust discharge chamber. In another embodiment, the PPT includes a means of varying the spacing between the electrode plates as a function of axial distance. In an other embodiment, slightly radioactive electrodes are used. In these ways ignition voltages and required power levels are achieved that are several orders of magnitude smaller than those previously obtainable.

Also disclosed is a method of operating a pulsed plasma thruster comprising the steps of heating a subliming solid to create a high pressure vapor and directing that high pressure vapor in the direction of a thrust discharge chamber through an ignition chamber. Next, a DC ignition signal is applied to electrodes coupled to the thrust discharge chamber that sparks a breakdown of a fuel propellent and causes a transition of the spark to a useful plasma arc. The DC ignition signal is applied in a way that its shape and magnitude are controlled. In one embodiment the DC ignition signal is controlled in three segments corresponding to an open circuit to constant voltage segment, a constant voltage segment and a constant current segment.

The high pressure vapor is directed to the thrust discharge chamber so that pressure is created between two electrode plates. The vapor can be fed uniformly to control ignition and breakdown of the fuel propellent. The spacing between the electrode plates may be adjusted to control the amount of the fuel propellent ablated. A source of ultraviolet radiation may be focused on the vapor to provide additional excitation energy that helps ignite the vapor from the subliming solid.

A technical advantage of the invention is the enablement of reliable ignitions at voltages more than an order of magnitude less that previously obtainable. This enables small and light-weight PPTs and power supplies and, therefore, much lighter PPT systems than previously obtainable.

Another advantage is the efficient enablement of impulse bits several orders of magnitude less than previously obtainable. This enables the deployment of PPTs suitable for space propulsion applications involving small spacecraft systems and for missions which require extremely precise control of the spacecraft.

BRIEF DESCRIPTION OF THE DRAWINGS

Other advantages of the invention including specific embodiments are understood by reference to the following detailed description taken in conjunction with the appended drawings in which.

References in the detailed description correspond to like references in the figures unless otherwise indicated.

DETAILED DESCRIPTION OF PREFERRED EMBODIMENTS

The present invention provides a pulsed plasma thruster (PPT) that can be used as a rocket engine for small spacecraft. The PPT operates on a pulse basis where a spark is created at low voltage via the use of small separations of electrodes using micro-electromechanical systems (MEMS) technology, independent introduction of vapor from solids, and electrodes which are slightly radioactive and specially shaped. The spark is transferred to an arc via use of a power supply with three output sections. The arc creates a plasma consisting of constituents of PTFE, which is ablated by the arc, and the vapors from the solids.

Figure 1:
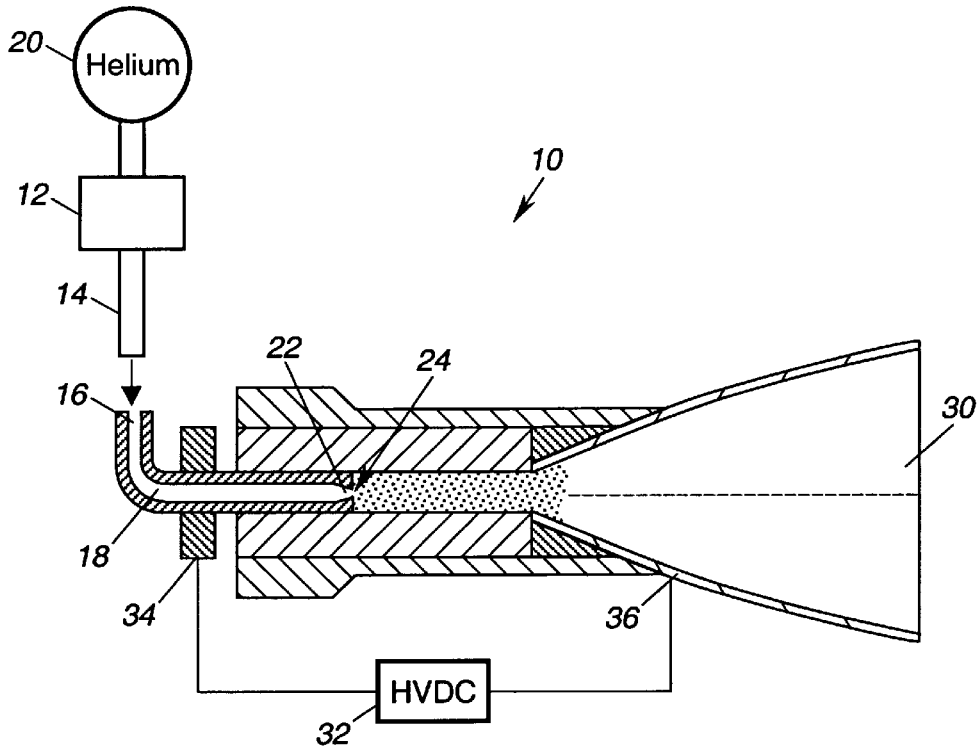
Figure 1 (Prior Art)
FIG. 1 illustrates a prior art liquid thruster that uses a high voltage power supply to create thrust.
Figure 2A:
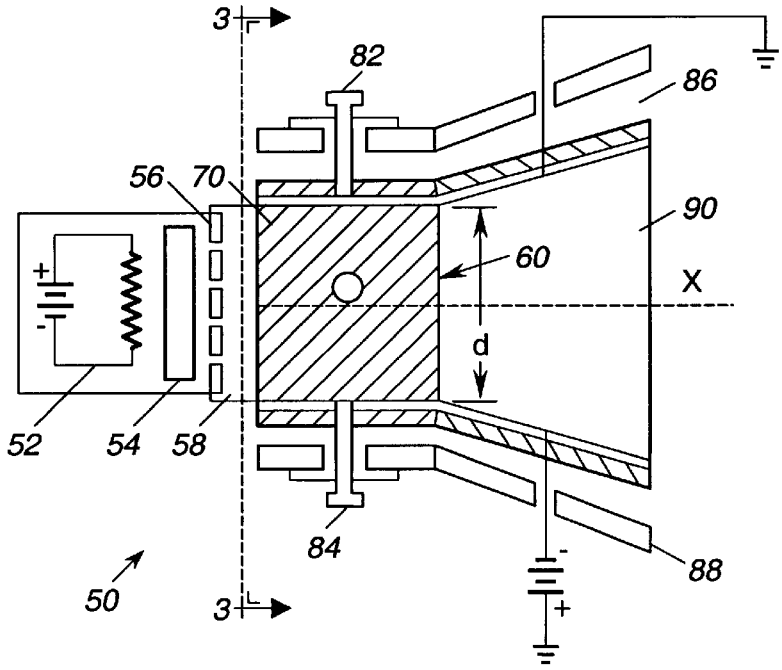
FIGS. 2*a* and 2*b* illustrate embodiments of a Pulsed Plasma Thruster (PPT) according to the invention.

Referring to FIG. 2*a*, a pulsed plasma thruster (PPT) according to one embodiment of the invention is shown and denoted generally as 50. The PPT 50 includes a heater 52 or other means of generating heat that is small enough to accommodate the framework of a small spacecraft. In one embodiment, the heater 52 is a micro-sized heater based on micro-electromechanical systems or MEMS technology.

The heater 52 is placed adjacent a subliming solid 54. The purpose of the subliming solid 54 is to provide a vapor source so that, in combination with the heater 52, the solid 54 generates a gas flow that assists ignition of an initial plasma arc in the spark region of the thruster 50. Thus, the heater 52 increases the temperature of the subliming solid 54 which, in turn, generates vapor. The vapor flows through a screen 56 and into an ignition section 58 of the thrust discharge chamber 70 where a spark partially ignites the solid fuel propellant 60 as well as some of the subliming solid 54 that has been vaporized. The action of the subliming solid 54 and resulting vapor, coupled with the screen 56 and configuration of the ignition section 58 assist in igniting a spark that creates a useful plasma arc.

In general, the subliming solid 54 has the characteristic of being able to produce a vapor when heated. A low sublimation temperature of the solid 54 is desired so a large quantity of vapor gas is generated for relatively small incremental changes in temperature. This reduces the heat generating requirements of the heater 52. While some gases provide better ignition sources than others, the requirement that the solid 54 produce easily ionized vapor restricts selection of the material to certain compounds. Candidates include carbonates ($X(HCO_3)$) and carbamates ($S(CO_2NH_2)$) which sublime into $NH_3$, $CO_2$, and $H_2O$. The use of subliming solids enables independent addition of vapor into the PPT, eliminates the requirements for valves and seals, and assures long term compatibility with space environments.

Figure 3:
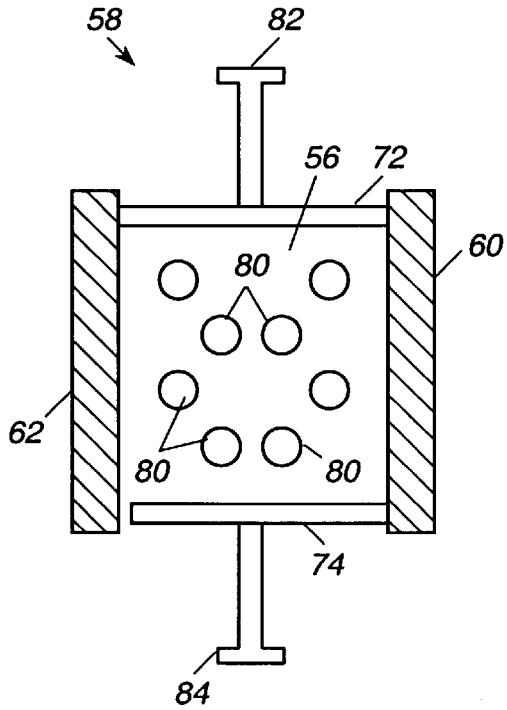
FIG. 3 is a cross section view of the ignition chamber of the PPT of the invention.

FIG. 3 is a cross section of the PPT 50 taken along line 3—3 of FIG. 2*a* and illustrating the arrangement of the ignition section of the thrust discharge chamber 70 in greater detail. As shown, the screen 56 contains a plurality of holes 80 which are spaced and sized to provide optimum feeding of vapor from the subliming solid 54 into the thrust discharge chamber 70. The number of holes 80 depends on the size of the ignition section 58 and the requirement that plasma in the ignition chamber must be allowed to enter the chamber that holds the solid 54 Thus, the sizing, diameter and quantity of the holes 80 is influenced by the specific configuration of the PPT 50.

Preferably, the velocity of the vapor into the ignition section 58 is kept relatively low. In general, many small holes are more effective than a few big holes. Also, the screen 56 is designed to separate the solid from the thrust discharge chamber 70 so that sparks and/or plasma does not interact with solid 54.

As shown, the thrust discharge chamber 70 is comprised of the two oppositely disposed electrode plates 72 and 74 and two fuel propellants 60 and 62. The fuel propellants 60 and 62 are preferably PTFE based, although other fuel sources may be utilized. In one embodiment, MEMS based micro-heaters (not shown) are embedded in the fuel propellents 60 and 62 and their temperature varied to control the amount of PTFE ablated and to provide more control of the impulse generated by the PPT 50. In another embodiment, solids 54 are placed along the thrust discharge chamber 70 and nozzle 90. The solids 54 contain micro-heaters which are independently controlled to allow the introduction of vapor into the thrust discharge chamber at optimum locations and times during the firing cycle. This vapor provides additional control of the efficiency and the impulse bits generated by the PPT 50.

Referring again to FIG. 2*a*, the PPT 50 also includes a set of electrode plates 72 and 74. The electrode plates 72 and 74 correspond to the anode and cathodes of the PPT 50, respectively. As shown, the distance "d" corresponds to the spacing between the electrode plates 72 and 74. In one embodiment, the distance "d" between the electrode plates 72 and 74 is 50 micrometers or less. Additionally, the electrode plates 72 and 74 are positioned so that they are evenly displaced about the central axis "x" running through the thrust discharge chamber 70 of the PPT 50.

An advantage of the PPT 50 is the ability to create a reliable breakdown within the thrust discharge chamber 70 using low levels of power. This is achieved, in part, by keeping the spacing "d" between the electrode plates 72 and 74 small so that a spark is more efficiently generated and ignition is achieved using less spark energy. Recent advances in MEMS technology enables the manufacture of small clearances between the electrode plates 72 and 74. Thus, the fact that the PPT 50 incorporates MEMS technology provides a PPT 50 suitable for space missions where power is limited.

According to various embodiments, the electrode plates 72 and 74 are spaced anywhere from 1 micrometer to 50 micrometers apart. In general, the closer the electrode plates 72 and 74 are spaced, the lower voltage is required to a ignite a breakdown.

Coupled to the electrode plates 72 and 74 are corresponding electrode terminals 82 and 84 that extend through an insulating layer 86 and the housing 88. The electrode terminals 82 and 84 are used to deliver the ignition voltage to the thrust discharge chamber 70. The insulating layer 86 extends substantially over the thrust discharge chamber 70 and the thrust nozzle 90. As is known to those of ordinary skill in the art, the insulating layer 86 can be configured to increase the local field strengths existing between electrode plates 72 and 74.

A disadvantage of prior art thrusters is that they require very high ignition voltages to operate. For example, the thruster 10 requires a DC supply anywhere from 2000 volts to 8000 volts. Such high voltages have been used in PPTs for a long time since they result in greater thrust. The present invention contemplates the use of voltages less than 300 volts. In one embodiment, the spacing of the electrode plates 72 and 74 is such that 50 volts is sufficient to create suitable thrust levels. This permits the PPT 50 to be utilized in typical satellite applications where 50 volts is commonly available.

Figure 2B:
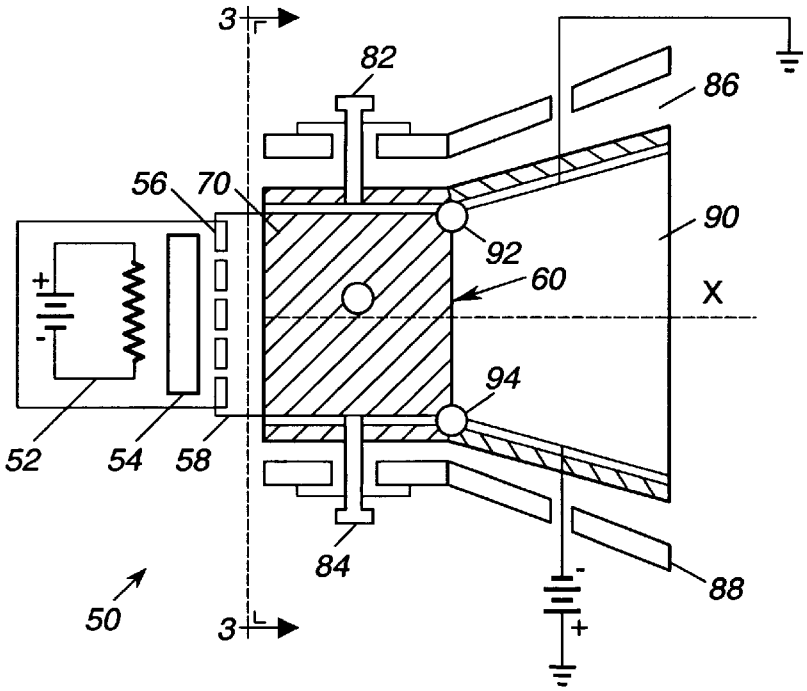

FIG. 2*b* illustrates another configuration of the PPT 50 according to the invention. Specifically, the PPT 50 is shown equipped with a means of adjusting the angle of the thrust nozzle 90 with respect to central axis "x". The hinges 92 and 94 are provided for this purpose although other means of achieving the same function can be employed. In this way, the PPT 50 becomes a fuel dynamic device since the angle of the thrust nozzle 90 has some effect on the amount of fuel utilized for certain levels of thrust.

Figure 4A:
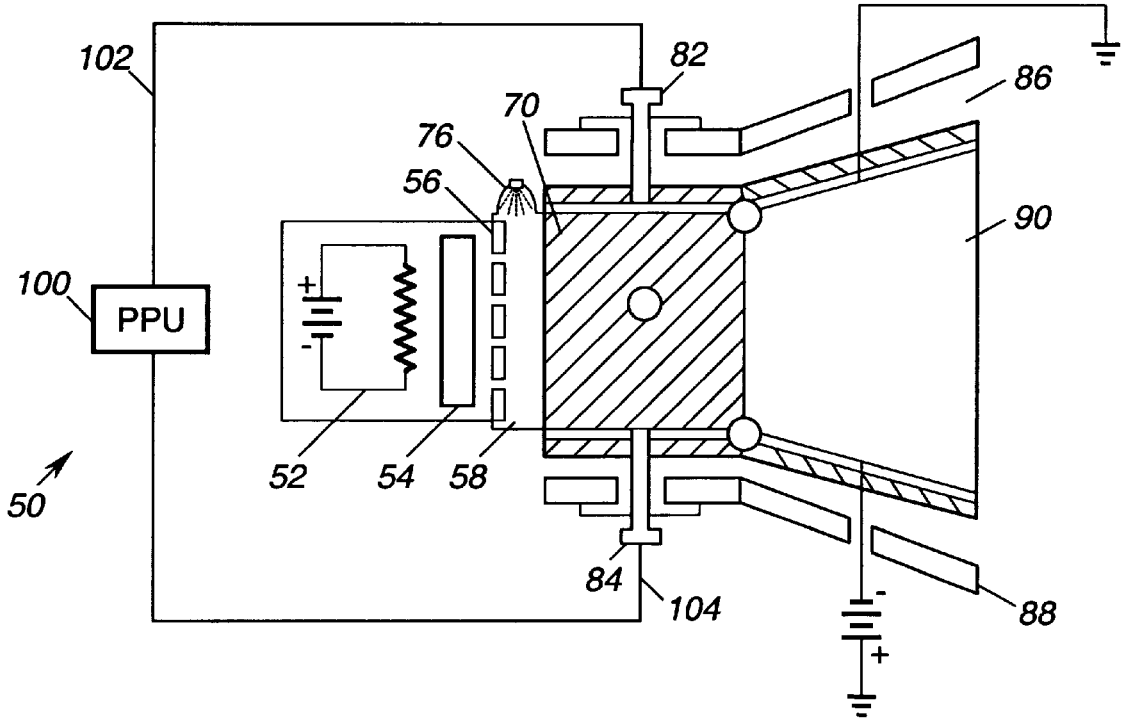
FIGS. 4*a* and 4*b* illustrate the use and operation of the variable power processing unit that powers the pulsed plasma thruster according to one embodiment.

Referring to FIG. 4*a*, therein is shown the PPT 50 driven by a power source 100 with terminals 102 and 104 coupled to electrode terminals 82 and 84, respectively. In general, the power source 100 is capable of producing multiple volt-ampere signal forms that effect the shape and magnitude of the ignition signal used to spark the vapors in the ignition section 58.

Figure 4B:
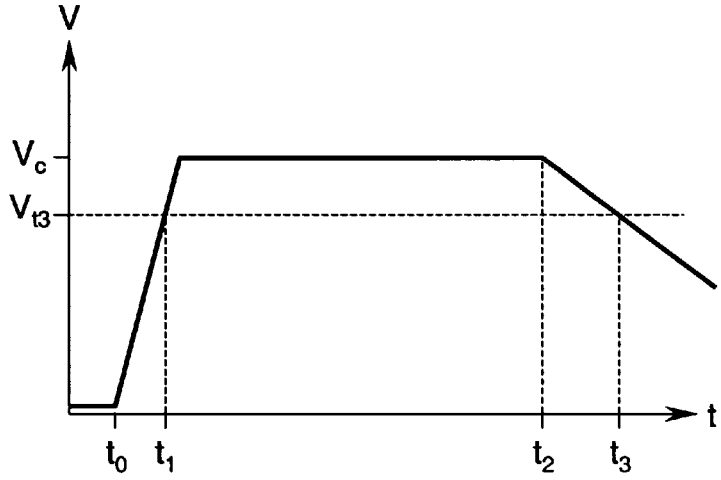

In one embodiment, the power source 100 comprises a flexible power processing unit that operates in the three segments: an open circuit to constant voltage segment, a constant voltage segment, and a constant current segment. The three segments are illustrated in the graph of FIG. 4*b*.

The open circuit voltage, Vo, from the power source 100 is applied to the electrodes. The vapor from solid 54 is also introduced into the ignition section 58 of the thrust discharge chamber. A spark occurs in the ignition section 58. During the next segment, the voltage decreases to the constant voltage section of the power source 100 at current Ic. The current then increases at a constant voltage, Vc, to a constant current section where the current is held constant at Io. The values of Vo, Vc, Ic, and Io are preset to desired values dependent on the specific design and operating condition of the PPT. Designs of power supplies capable of such outputs are known to those of ordinary skill in the art.

Figure 5:
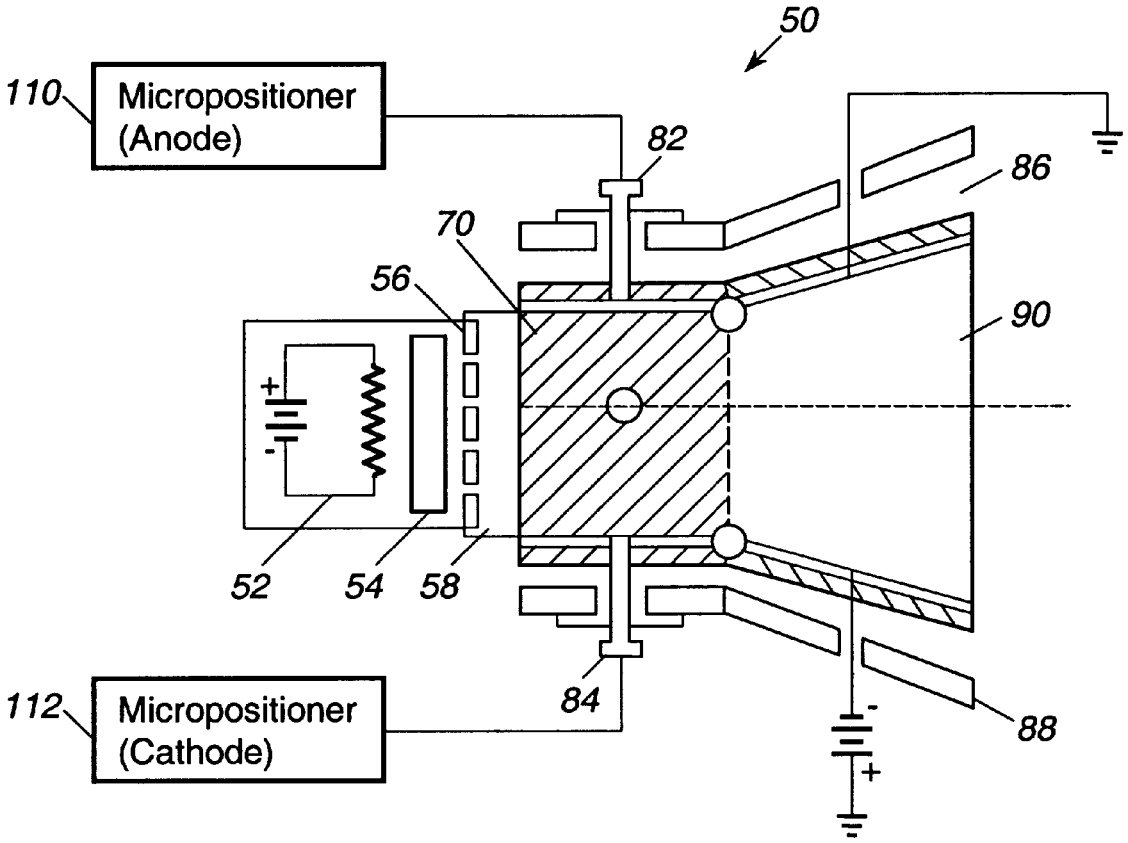
FIG. 5 illustrate the micro-positioning of the electrode plates of the pulsed plasma thruster according to one embodiment.

With reference to FIG. 5, the PPT 50 is equipped with micro-positioning devices 110 and 112 operably coupled to the electrode terminals 82 and 84, respectively. The purpose of the micro-positioning devices 110 and 112 is to adjust the positioning and spacing of the electrode plates 72 and 74 with respect to the central axis "x". Preferably, the micro-positioning devices 110 and 112 are MEMS based so that they fit the framework of a small spacecraft and require only small amounts of power to operate. In this way, the spacing between each electrode plates 72 and 74 can be varied as a function of axial distance from the upstream end of the thrust discharge chamber 70.

While the invention has been described in conjunction with preferred embodiments, it should be understood that modifications will become apparent to those of ordinary skill in the art and that such modifications are therein to be included within the scope of the invention and the following claims.

What is claimed is:

1. A pulsed plasma thruster comprising:

vapor producing solids;

heat producing means arranged adjacent said solids;

a thruster housing having a thrust discharge chamber with a plurality of openings, a thrust nozzle, and a fuel propellant in said thrust discharge chamber;

passageways leading from said solids to said thrust discharge chamber within said housing, the passageways arranged so that vapors from said solids are received through said openings of said thrust discharge chamber;

first and second electrodes extending from said thrust discharge chamber through said housing; and a power source coupled to said first and second electrodes and configured to enable spark breakdown between the electrodes of said thrust discharge chamber, the power source configured to control the voltage-current shape of spark breakdown that results in a plasma arc capable of ablating said fuel propellant, and ionizing said solid vapors and fuel propellants within said thrust discharge chamber to create a thrust force outwardly directed from said thrust nozzle.

2. The thruster of claim 1 wherein said passageways are configured to separate said solids from said thrust discharge chamber so that sparks and plasma do not interact with said solids.

3. The thruster of claim 1 wherein said passageways includes a plurality of holes adjacent said solids.

4. The thruster of claim 3 wherein said holes are arranged so that vapors are optimally fed into said thrust discharge chamber.

5. The thruster of claim 1 further comprising a means of varying the angle of said thrust nozzle with respect to a central axis extending through said thrust discharge chamber.

6. The thruster of claim 1 wherein said heat producing means are MEMS micro heaters capable of independently producing sufficient quantities of heat to cause said solids to sublime at times and locations to reduce ignition voltages and increase the PPT efficiency at desired values of propellant velocity.

7. The thruster of claim 1 wherein said first and second electrodes are made of a slightly radioactive material.

8. The thruster of claim 1 wherein said power source delivers a maximum DC voltage signal of 300 volts.

9. The thruster of claim 1 wherein said power source is configured to control the shape and magnitude of said ignition signal in three segments corresponding to an open circuit to a constant voltage segment, a constant voltage segment, and a constant current segment.

10. The thruster according to claim 1 further comprising a means of varying the spacing as a function of axial distance between said electrodes.

11. The thruster according to claim 1 wherein the fuel propellant comprises PTFE.

12. A pulsed plasma thruster comprising:

solids capable of producing a high pressure vapors;

heat generating elements adjacent said solid and operably configured to generate heat that causes said solids to sublime;

an ignition chamber forming a passageway from said solid to a thrust discharge chamber, said ignition chamber having a plurality of holes for guiding vapors from said solid to said thrust discharge chamber;

said thrust discharge chamber having first and second ends, said first end coupled to said ignition chamber, said thrust discharge chamber further including two oppositely positioned electrode plates and two oppositely positioned fuel propellants, each of said electrode plates coupled to corresponding electrode terminals a nozzle coupled to said second end of said thrust discharge chamber; and a power processor unit coupled to said electrode plates through said electrode terminals and configured to provide an ignition voltage that causes a plasma arc to occur in the gap between said electrode plates;

wherein said electrode plates are sized and shaped to assure transfer of said plasma arc in the direction of said nozzle to cause a predictable amount of said fuel propellants to be ablated and create a thrust force that exits said nozzle.

13. The pulsed plasma thruster according to claim 12 further including an insulating layer extending substantially over said thrust discharge chamber and said nozzle.

14. The pulsed plasma thruster according to claim 13 further including a housing surrounding said insulating layer with openings that allow access to said electrode terminals.

15. The pulsed plasma thruster according to claim 12 wherein the spacing between said electrode plates is less than 50 micrometers.

16. The pulsed plasma thruster according to claim 12 further comprising a UV variable intensity light source predisposed to provide an ignition signal that sparks vapors within said ignition chamber.

17. The pulsed plasma thruster according to claim 12 further comprising a means of varying the angle of said nozzle with respect to said thrust discharge chamber.

18. The pulsed plasma thruster according to claim 12 wherein said power processing unit is capable of producing multiple volt-amp signal forms that effect the shape of said ignition voltage.

19. The pulsed plasma thruster according to claim 18 wherein said power processing system produces an ignition voltage signal in three segments corresponding to an open circuit to constant voltage segment, a constant voltage segment and a constant current segment.

20. The pulsed plasma thruster according to claim 12 wherein said fuel propellants comprise PTFE propellants.

21. The pulsed plasma thruster according to claim 12 wherein said heat generating element comprises a micro-heater capable of heating said solid to create a vapor that travels into said thrust discharge chamber and exerts a pressure on said electrode plates.

22. The pulsed plasma thruster according to claim 12 wherein said holes of said ignition chamber are sized and located to provide uniform feeding of vapors subliming from said solid to said discharge thruster.

23. The pulsed plasma thruster according to claim 12 further comprising a plurality of heating elements embedded in said fuel propellants.

24. The pulsed plasma thruster according to claim 23 wherein said heating elements comprise variable temperature MEMS-based micro-heaters that can control the amount of said fuel propellants ablated.

25. The pulsed plasma thruster according to claim 12 wherein said thrust discharge chamber is arranged to prevent either of an ignition voltage and plasma arc from interacting with said solid.

26. The pulsed plasma thruster according to claim 12 wherein said electrode plates are evenly spaced about a central axis extending through said thrust discharge chamber.

27. The pulsed plasma thruster according to claim 12 further comprising first and second electrode positioning devices predisposed about said first and second electrode plates, respectively, for varying the spacing of said electrode plates as a function of the distance to a central axis extending through said thrust discharge chamber.

28. The pulsed plasma thruster according to claim 13 wherein said insulating layer is shaped to increase the local field strengths existing between said electrode plates.

29. The pulsed plasma thruster according to claim 12 wherein said ignition voltage less than 300V.

30. The pulsed plasma thruster according to claim 14 wherein said housing includes a means of mounting said thruster to a mass to be propelled.

31. A method of operating a pulsed plasma thruster having a heat generator means predisposed adjacent a subliming solid, a thrust discharge chamber formed of two oppositely positioned electrode plates and two oppositely positioned PTFE propellants, a device separating the subliming solid from the thrust discharge chamber, a power source coupled to the electrode plates and capable of providing an ignition voltage, the method comprising the steps of:

heating the subliming solid to create a high pressure vapor;

directing the high pressure vapor in the direction of said thrust discharge chamber; and applying a DC ignition signal to said electrodes to spark a breakdown of the PTFE propellants and cause a transition of the spark to a useful plasma arc.

32. The method of operating a pulsed plasma thruster according to claim 31 wherein the step of applying a DC ignition signal is performed by controlling the shape and magnitude of the output of the power source.

33. The method of operating a pulsed plasma thruster according to claim 32 wherein the shape is controlled in three segments corresponding to an open circuit to constant voltage segment, a constant voltage segment and a constant current segment.

34. The method of operating a pulsed plasma thruster according to claim 32 wherein the step of directing the high pressure vapor in the direction of said thrust discharge chamber is performed in a manner that creates pressure between the two electrode plates of the thrust discharge chamber.

35. The method of operating a pulsed plasma thruster according to claim 32wherein the step of directing the high pressure vapor in the direction of said thrust discharge chamber is performed so that the vapor is fed uniformly to the thrust discharge chamber.

36. The method of operating a pulsed plasma thruster according to claim 32 further comprising the step of transferring an initial spark to a plasma arc in the gap defined by the separation of the electrode plates.

37. The method of operating a pulsed plasma thruster according to claim 36 wherein the step of transferring is performed in such a manner that an amount of PTFE propellant is ablated.

38. The method of operating a pulsed plasma thruster according to claim 37 wherein the amount of PTFE propellant is ablated in a controlled manner.

39. The method of operating a pulsed plasma thruster according to claim 32 wherein the step of applying a DC ignition signal to said electrodes is performed by focusing an ultraviolet light source on the high vapor pressure.

40. The method of operating a pulsed plasma thruster according to claim 32 further comprising the step of adjusting the spacing of the electrode plates to effect the force delivered by the propellants.

41. The method of operating a pulsed plasma thruster according to claim 32 wherein the step of applying a DC ignition signal to said electrodes is performed by limiting the DC voltage signal to less than 300 volts.

* * * * *

UNITED STATES PATENT AND TRADEMARK OFFICE
Certificate

Patent No. 6,216,445 Patented: April 17, 2001

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: David C. Byers, Torrance; David H. Lewis, Jr., Irvine; and Erik K. Antonsson, Pasadena; all of CA (US).

Signed and Sealed this Tenth Day of September 2002.

TIMOTHY S. THORPE
*Supervisory Patent Examiner*
Art Unit 3746